US008574428B2

(12) United States Patent
Schucker

(10) Patent No.: US 8,574,428 B2
(45) Date of Patent: Nov. 5, 2013

(54) DESULFURIZATION OF PETROLEUM STREAMS USING METALLIC SODIUM

(75) Inventor: Robert C. Schucker, The Woodlands, TX (US)

(73) Assignee: Trans Ionics Corporation, The Woodlands, TX (US)

( * ) Notice: Subject to any disclaimer, the term of this patent is extended or adjusted under 35 U.S.C. 154(b) by 783 days.

(21) Appl. No.: 12/528,728

(22) PCT Filed: Feb. 25, 2008

(86) PCT No.: PCT/US2008/054891

§ 371 (c)(1), (2), (4) Date: Jul. 14, 2010

(87) PCT Pub. No.: WO2008/106402

PCT Pub. Date: Sep. 4, 2008

(65) Prior Publication Data

US 2010/0276335 A1 Nov. 4, 2010

Related U.S. Application Data

(63) Continuation-in-part of application No. 11/679,071, filed on Feb. 26, 2007, now Pat. No. 7,588,680, which is a continuation-in-part of application No. 10/826,621, filed on Apr. 16, 2004, now Pat. No. 7,192,516.

(60) Provisional application No. 60/978,812, filed on Oct. 10, 2007.

(51) Int. Cl.
*C10G 19/08* (2006.01)

(52) U.S. Cl.
USPC ..... 208/208 M; 208/14; 208/143; 208/209; 208/230; 208/235

(58) Field of Classification Search
USPC ..... 208/14, 143, 208 M, 209, 230, 232, 235
See application file for complete search history.

(56) References Cited

U.S. PATENT DOCUMENTS

2005/0145545 A1* 7/2005 Schucker ..... 208/208 M

* cited by examiner

*Primary Examiner* — Brian McCaig
(74) *Attorney, Agent, or Firm* — Ramey & Browning, PLLC

(57) ABSTRACT

In some embodiments, the invention is a method of removing sulfur from a hydrocarbon feed using the steps of dissolving metallic sodium in a first solvent, combining the sodium/first solvent solution with a sulfur-free alkane or cycloalkane second solvent, vaporizing the first solvent from sodium/first solvent/second solvent combination to transfer the dissolved metallic sodium into the second solvent, and then combine the resultant liquid with a liquid hydrocarbon feed containing an organosulfur species. The resulting stream is combined with a hydrogen donor. The combination is heated and pressurized to form a liquid hydrocarbon product containing sodium sulfide. The liquid hydrocarbon product containing sodium sulfide is then cooled, and the sodium sulfide is extracted. The extracted sodium sulfide is then processed in a sodium sulfur cell to regenerate the sodium and recycle it to the feed.

23 Claims, 1 Drawing Sheet

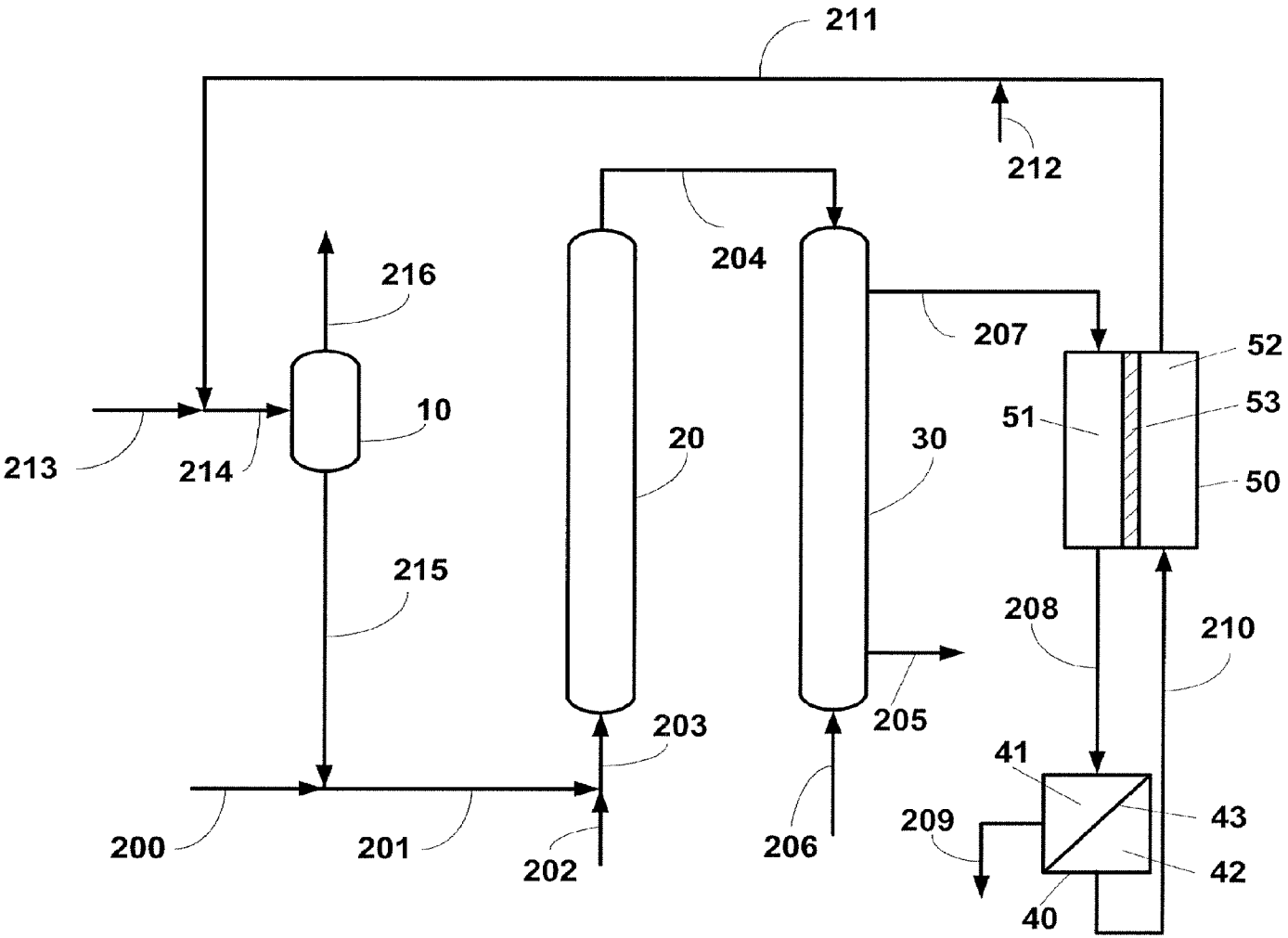
52
53
50
210
43
42
212
207
51
208
41
40
211
30
205
209
206
204
20
203
202
216
10
215
201
214
200
213

DESULFURIZATION OF PETROLEUM STREAMS USING METALLIC SODIUM

This application is a continuation-in-part of U.S. patent application Ser. No. 11/679,071, now U.S. Pat. No. 7,588,680, filed Feb. 26, 2007, which is a continuation-in-part of U.S. patent application Ser. No. 10/826,621, now U.S. Pat. No. 7,192,516, filed Apr. 16, 2004. This application also claims priority benefit under 35 U.S.C. 119(e) to provisional U.S. Patent Application Ser. No. 60/978,812 filed Oct. 10, 2007.

BACKGROUND OF INVENTION

There are several known ways of removing sulfur from petroleum streams, which fall into two primary categories: (a) catalytic hydrotreating processes in which the feed is passed over a hydrotreating catalyst at elevated temperatures and hydrogen pressures and (b) non-hydrotreating processes. The present disclosure provides an improved non-hydrotreating process.

Non-hydrotreating processes can be further divided into those that remove the entire sulfur-bearing molecule from the feed by adsorption onto a selective adsorbent, as exemplified by Khare (U.S. Pat. No. 6,274,533; U.S. Pat. No. 6,338,794 and U.S. Pat. No. 6,482,314), and those that remove only the sulfur by chemical reaction. The latter can further be divided into those that are oxidative in nature, as exemplified by Rappas (U.S. Pat. No. 6,402,940), Ohsol, et al (U.S. Pat. No. 5,985,137; U.S. Pat. No. 5,948,242), Yen (U.S. Pat. No. 6,402,939) and Gunnerman (U.S. Pat. No. 6,500,219), and those that are reducing in nature. The most important of the reducing processes is reaction of a feed containing organosulfur species with elemental sodium as exemplified by Brons, et al (U.S. Pat. No. 6,210,564), Baird (U.S. Pat. No. 4,003,824; U.S. Pat. No. 4,123,350) and Bearden (U.S. Pat. No. 3,787,315; U.S. Pat. No. 3,788,978; U.S. Pat. No. 3,791,966; U.S. Pat. No. 3,976,559 and U.S. Pat. No. 4,076,613).

In order to contact elemental sodium with feed, the sodium is typically melted (m.p.=97.8° C.) and added to the feed as a dispersion of small droplets. Even with intense mixing, it is not possible to produce extremely small droplet sizes. As a result, sodium on the surface of the droplets may react with sulfur in the feed to form a skin of sodium sulfide ($Na_2S$). This skin remains on the droplet exterior surface, and as $Na_2S$ has a melting point of 1,180° C., it remains as a solid under the conditions of desulfurization. The skin thereby inhibits further reaction between the sodium in the interior of the droplet and sulfur in the feed. For these reasons, it has been necessary in the prior art to use substantially higher ratios of sodium to feed sulfur than are stoichiometrically required in order to remove sulfur to the desired level.

BRIEF DESCRIPTION OF INVENTION

The present invention is directed to the process of removing sulfur from a wide range of liquid feeds which overcomes limitations in the prior art. The invention is a process of removing sulfur from a liquid feed containing organosulfur compounds and the products of said process The process may involve dissolving metallic sodium in a first solvent to form a solution of sodium atoms. The process may involve combining the solution of sodium atoms with a second solvent to form a combined stream, wherein the combination occurs at a temperature of addition and at a pressure above the vapor pressure of the solvent used to dissolve the metallic sodium at the temperature of addition. In some embodiments, the second solvent is a substantially sulfur-free solvent. For example, the substantially sulfur-free solvent may be selected from a group consisting essentially of alkane or cycloalkane species, or combinations thereof. Examples of alkane species include mineral oil and aromatic-free substantially sulfur-free kerosene. An example of a cycloalkane specie includes decahydronaphthalene. The process may involve a reduced combined stream produced by lowering the pressure of the combined stream to achieve vaporization of the first solvent from the combined stream. The process may involve dispersing the reduced combined stream into a liquid hydrocarbon feed stream comprising organosulfur species to form a feed stream. The process may involve passing the feed stream into a pressurized reactor vessel in addition to a hydrogen-donor stream. For example, the hydrogen-donor stream may be selected from a group consisting essentially of hydrogen or a hydrogen donor solvent, or combinations thereof. The process may involve reacting the feed stream and the hydrogen-donor stream for a sufficient time and at sufficient temperature to form a modified composition comprising sodium sulfide and less organosulfur species that had been present in the feed stream. The process may further involve cooling the modified composition. The process may further involve extracting the sodium sulfide from the modified composition using an extraction fluid. The process may further involve processing the sodium sulfide produced by desulfurizing the feed using a sodium sulfur cell to regenerate elemental sodium. The process may further involve recirculating the elemental sodium to the feed. According to some embodiments, the invention may include the products of the aforementioned process. According to some embodiments, the first solvent used is anhydrous ammonia. According to some embodiments, the temperature of addition is at or below the melting point of metallic sodium. For example, the temperature of addition may be about 25° C. According to some embodiments, the sufficient time may be in the range of about 5 and 60 minutes. According to some embodiments, the sufficient temperature may be in the range of about 25° C. and 350° C. For example, the sufficient temperature may be in the range of about 200° C. and 350° C. According to some embodiments, the extraction fluid composition may include a solvent for sodium sulfide. For example, the solvent for sodium sulfide may be substantially anhydrous ammonia. According to some embodiments, the molar ratio of sodium to sulfur may be in the rage of about 2.5:1 to 2:1.

It is readily apparent to those skilled in the art that many different solvents, including but not limited to ammonia and some ethers, may be used to dissolve metallic sodium. It is also apparent to those skilled in the art that many different reactor and flow configurations may be used to carry out the desulfurization process.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF DRAWING

The foregoing summary as well as the following detailed description of the preferred embodiment of the invention will be better understood when read in conjunction with the appended drawing. It should be understood, however, that the invention is not limited to the precise arrangements and instrumentalities shown herein. The components in the drawing are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawing, in which:

FIG. 1 illustrates a schematic of an embodiment of the process described in the application.

DETAILED DESCRIPTION OF THE INVENTION

The principles of the present invention and their advantages are best understood by referring to FIG. 1 of the drawings, like numerals being used for like and corresponding parts of the various drawings.

In the following descriptions and examples, specific details are set forth such as specific quantities, sizes, etc., to provide a thorough understanding of the present invention. However, it will be obvious to those skilled in the art that the present invention may be practiced without such specific details. In many cases, details concerning such considerations and the like have been omitted inasmuch as such details are not necessary to obtain a complete understanding of the present invention and are within the skills of persons of ordinary skill in the relevant art.

In FIG. 1, metallic sodium is dissolved in a first solvent to create a solution of sodium atoms. In some embodiments, liquid anhydrous ammonia is used as the first solvent. The solution of sodium atoms is introduced into the process via stream 211. Stream 211 is maintained at a temperature and pressure so that the first solvent remains in the liquid phase. In some embodiments, a temperature in the range of about 25° C. to about the melting point of metallic sodium (97.81° C.) is used. In some embodiments, a temperature in the range of about 0° C. to the melting point of metallic sodium is used. For the remainder of the description, it is assumed that liquid anhydrous ammonia is the first solvent.

Sodium is well known to be very soluble in liquid ammonia (U. Schindewolf, Angew. Chem. Internat. Edit., Vol. 7 (1968)/No. 3) with solubilities as high as 6 M (approximately 20 wt %) possible. In some embodiments, the concentration of sodium in ammonia is 0.1 to 20 wt %. In some other embodiments, the concentration of sodium in ammonia is 0.5 to 20 wt %. In some other embodiments, the concentration of sodium in ammonia is 1.0 to 20 wt %. The formation of the solution of sodium atoms can be assisted by using small pieces of sodium metal and using agitation, such as that provided with ultrasonic mixing, to assist in forming the solution.

In some embodiments, the temperature of the solution of sodium atoms should be about 25° C. to minimize the total pressure. Temperatures higher than 25° C. can be employed but those embodiments require the use of higher pressures in order to maintain the ammonia in the liquid phase. It is desired that the temperatures remain below the critical temperature of ammonia (132.6° C.) since sodium is not as soluble in supercritical ammonia as in liquid ammonia.

In some embodiments, the stoichiometric molar ratio of sodium to feed sulfur in a liquid hydrocarbon feed is around 2:1, corresponding to the composition $Na_2S$. In some embodiments, a slightly higher ratio may be needed (e.g., 2.1:1) to account for inherent inefficiencies in the process, such as some sodium failing to contact an organosulfur molecule.

Stream 211, the solution of sodium atoms, is combined and blended with a stream 213 to create a combined stream 214. Stream 213 is essentially composed of a second solvent that is relatively compatible with the hydrocarbon feed stream and that can maintain the dissolved sodium atoms in solution. In some embodiments, the second solvent is a substantially sulfur-free solvent. For example, the substantially sulfur-free solvent may be an alkane solvent, such as mineral oil or an aromatic-free, substantially sulfur-free kerosene, or a cycloalkane solvent, such as decahydronaphthalene. Stream 213 is maintained at a temperature and pressure so that, when combined with stream 211, the first solvent remains in the liquid phase. In some embodiments, a temperature in the range of about 25° C. to the melting point of metallic sodium (97.81° C.) is used. In some embodiments, a temperature in the range of about 0° C. to the melting point of metallic sodium is used.

Both first and second solvents should be substantially water-free, since water contained in the solvent would react readily with metallic sodium thus forming sodium hydroxide, which is not effective for removal of sulfur from organosulfur species. Additionally, by use of a second solvent that has affinity with the hydrocarbon stream to be processed, the delivery of sodium atoms to the target organosulfur molecules is enhanced.

The combined stream 214, comprised of the first solvent, the second solvent, and solubilized sodium atoms, is delivered into separator vessel 10, which, in some embodiments, is maintained at a pressure below the vapor pressure of the first solvent at operating temperature. In some embodiments, the operating temperature is in the range of about 25° C. to 95° C. The operating temperature provides a means for removal of the ammonia, which is again assumed to be the first solvent, by vaporization. In some embodiments, the vapor pressure of the combined stream 214 entering the vessel is higher than that of the liquid composition exiting the vessel 10 via the bottom. The pressure drop in vessel 10 results in the flashing of the first solvent and produces a liquid solution at the bottom of vessel 10 comprised mainly of finely divided, extremely small (i.e., microparticulate or nanoparticulate) sodium particles well distributed throughout the second solvent.

Because of their size, the sodium particles now dispersed in the second solution have a much smaller volume than larger droplets of liquid sodium employed in the processes of the prior art; and the effective surface area (that available for as a reactant surface) of these particles is greater than that available from a comparable amount of liquid sodium droplets used in the prior art processes.

Ammonia flashed from the combined stream 214 in vessel 10 exits the vessel through line 216. The tails of the flashing process, mainly comprised of fine sodium particles and the second solvent, exits through line 215 as the reduced combined stream. In some embodiments, the temperature of stream 215 is maintained below the melting point of sodium, thereby eliminating coalescence of sodium droplets prematurely. Flashing at temperatures above the melting point of sodium may increase the potential for sodium to coalesce in the resulting feed 215.

The reduced combined feed 215 is then blended with a liquid hydrocarbon feed stream comprising organosulfur species 200, creating a feed stream 201.

In some embodiments, a hydrogen donor is introduced into the feed stream 201 through line 202 forming mixed stream 203 which is fed into the desulfurization reactor 20. Assuming the hydrogen donor is hydrogen gas, the hydrogen pressure in these embodiments is significantly lower than in catalytic hydrotreating systems (about 800-1500 psig). The chemistry of desulfurization of sulfur compounds with metallic sodium results in significantly lower hydrogen consumption than in hydrotreating methods. In some embodiments, the hydrogen pressure is in a range from about 25 psig to 500 psig. In some other embodiments, the hydrogen pressure is in a range from about 50 psig to 400 psig. In some other embodiments, the hydrogen pressure is in a range from about 100 psig to 300 psig.

Stream 203 will need to be heated to reaction temperature prior to entering reactor 20. In some embodiments, mixed hydrogen/feed stream is held at a reaction temperature for a sufficient length of time to promote the reaction between metallic sodium and organosulfur species. The desired temperature and pressure will depend on the particular organosulfur constituency of the feed, and the reaction time will depend upon the temperature and pressure chosen. In some embodiments, the reaction time is in the range of about 5 minutes to 60 minutes.

The reaction between sodium and organosulfur species occurs readily over a wide range of temperatures and can be shown to be highly thermodynamically favored in a temperature range of about 25° C. and 350° C. Dibenzothiophene has been desulfurized by sodium at 150° C. to produce 99% biphenyl as the product (Z. Yu et al., Energy and Fuels, 1999, 13, 23-28), while most of the prior art previously cited previously carried out the desulfurization reactions at higher temperatures. In some embodiments, the operating temperature for desulfurization is in a range of about from 25° C. and 350° C. In some other embodiments, the operating temperature for desulfurization is in a range of about from 100° C. and 350° C. In some other embodiments, the operating temperature for desulfurization is in a range of about from 200° C. and 350° C. In some embodiments, the preferred reaction temperature may exceed the melting point of sodium and hence raise the potential for sodium to coalescence within the feed prior to reaction with the organosulfur portion of the hydrocarbon. This effect can be minimized by choosing the reaction temperature/pressure to reduce the residence time of the feed in reactor 20, and, upon introduction or immediately prior to the introduction of the mixed hydrogen/feed stream into vessel 20, to rapidly heat the mixed hydrogen/feed stream temperature to the desired temperature. The desired temperature of the reactants can be less than that within the reactor 20 as the desulfurization reaction is exothermic, and hence, once the reaction begins, a temperature rise in the reactor 20 will occur. In certain embodiments, cooling of the reactant vessel may be desired.

It is also well known in the art that chemical reactions involving metallic sodium and organosulfur species occur more slowly at lower temperatures and more rapidly at higher temperatures; however, this may be a result of decreased available surface area of reactive sodium. In some embodiments, reactor residence time range from about 5 minutes to 240 minutes. In some other embodiments, reactor residence time range from about 5 minutes to 120 minutes. In some other embodiments, reactor residence time range from about 5 minutes to 60 minutes. Longer residence times result in increased capital cost because of the required larger reactor vessels.

Removal of sulfur from organosulfur species is also dependent on the hydrogen pressure. While desulfurization can be achieved under an inert atmosphere such as nitrogen, char formation (a coke precursor) is favored in that case (H. W. Sternberg et al, Ind. Eng. Chem, Proc. Des. Dev., 13 (4), 1974, 433-436). In some embodiments, a hydrogen atmosphere is used. In some embodiments, a hydrogen donor solvent (a "solvent" in the sense of the hydrogen donor solvent being substantially miscible in the hydrocarbon feed) is used. For example, hydrogen solvents include but are not limited to tetra-hydronaphthalene or tetra-hydroquinoline. Additionally, in some embodiments, a combination of hydrogen gas and a hydrogen donor solvent could be used. Hydrogen gas or a hydrogen donor solvent, alone or in combination, will be considered a "hydrogen donor." Enough hydrogen to stabilize those molecules containing the sulfur is required. For instance, when the hydrogen donor is hydrogen gas alone, only one mole of hydrogen gas ($H_2$) per mole of sulfur is stoichiometrically required (again, slightly higher amounts of hydrogen may be needed to account for inherent inefficiencies in the process). Therefore, the present invention saves a significant amount of hydrogen over what is consumed in catalytic hydrotreating. In some embodiments, the hydrogen pressure is in a range of about 25 psig to 1000 psig. In some other embodiments, the hydrogen pressure is in a range of about 50 psig to 500 psig. In some other embodiments, the hydrogen pressure is in a range of about 250 psig to 300 psig.

The desulfurized feed now containing sodium sulfide ($Na_2S$) exits reactor 20 through line 204. In some embodiments, the feed is cooled. In some embodiments, the feed is fed to extraction vessel 30. Extraction fluid, which, in some embodiments, may be substantially anhydrous liquid ammonia (either from line 216 after compression or fresh liquid ammonia) or another suitable solvent, is added to the extractor 30 through line 206 and flows countercurrent to the feed to remove sodium sulfide. A residue solvent stream containing extracted sodium sulfide exits through line 207 and desulfurized product exits through line 205. In extractor 30, the solvent to feed ratio is adjusted to obtain the optimum performance, which is known to those skilled in the art. Further, the feed may be introduced at the top or the bottom of extractor 30 depending on the relative density of the feed versus the extraction solvent.

It will be recognized to those skilled in the art that the sodium sulfide reaction product may be removed by ordinary filtration, centrifugation or other means; however, these techniques are not expected to produce the quantitative removal of sodium sulfide achieved by extraction into liquid ammonia or a similar solvent.

In some embodiments, the hydrogen donor, in the form of hydrogen gas, is introduced in the process stream at the reactor vessel 20. In some embodiments, the hydrogen donor could be introduced into liquid hydrocarbon feed stream prior to the separation chamber reaction (flashing) such as by mixing with the feed stream prior to mixing with the sodium/solvent solution, or after mixing with the solution. In some embodiments, the hydrogen donor temperature should be close to that of the liquid stream. In some embodiments, the pressure of addition (for hydrogen gas) is in the range of about 5 and 200 psig. In some other embodiments, the pressure of addition is in the range of about 20 and 200 psig. In some embodiments, the pressure of addition is in the range of about 100 and 200 psig. In some embodiments, the molar ratio of donatable hydrogen to feed sulfur is in the range of about 1:1 to 2:1. Alternatively, the hydrogen donor, generally in the form of hydrogen gas, could be mixed with the solvent/sodium solution (to the solvent prior to the introduction of the sodium).

In another aspect, a method of desulfurization of hydrocarbons using the techniques disclosed herein may include a process to regenerate the sodium from the sodium sulfide contained in the stream exiting through line 207. This can be performed continuously, semi-continuously, or in batch mode. Preferably, a sodium-sulfur cell might be used, as described in assignee's U.S. Pat. No. 7,255,961 which is incorporated herein by reference in its entirety. The cell described in the '961 patent is a secondary battery, meaning that it can be recharged. To run the battery in the charging mode, it is necessary to apply a potential (approximately 2.1 V), which results in the production of elemental sodium as a product.

This sodium regeneration method traditionally envisions feeding sodium sulfide ($Na_2S$) or, alternatively, molten sodium polysulfide ($Na_xS_x$, where x=3-5) to the anode side of the battery wherein sodium ions diffuse across the electrolyte generating elemental sodium at the cathode. One problem is that sodium sulfide ($Na_2S$) melts at >1000° C., and therefore would be a solid at normal operating conditions. One solution is to use liquid ammonia as the solvent for $Na_2S$ in the battery. The solubility of $Na_2S$ is quite good in liquid ammonia at temperatures ranging from 20° C. to approximately 110° C.; and liquid ammonia has the benefit of being electrically conductive making it an excellent solvent of choice for this system.

In order to regenerate elemental sodium for recycle to the feed, the present invention incorporates a sodium sulfur cell 50 as shown in FIG. 1 having an anode compartment 51, a cathode compartment 52 and a solid electrolyte 53. Liquid ammonia containing $Na_2S$ exiting extractor 30 through line 207 is fed to the anode compartment 51, wherein $Na^+$ ions diffuse across electrolyte 53 into the cathode compartment 52, where $Na^+$ is reduced to elemental sodium)($Na^0$ according to the following reaction.

$$2Na^+ + 2e^- \leftrightarrow 2Na^0$$

At the same time the following reaction occurs at the anode producing elemental sulfur.

$$S^= \leftrightarrow S^0 + 2e^-$$

One skilled in the art will recognize that the temperature of operation of sodium sulfur cell 50 may be lower than the melting point of sulfur (112-116° C.); and since elemental sulfur is not soluble in liquid ammonia, it is expected to precipitate out as a fine solid in anode compartment 51. Liquid ammonia depleted in sodium and containing the finely dispersed sulfur exits the anode compartment 51 through line 208. Removal of sulfur may be carried out by any number of means known to those skilled in the art. One embodiment uses a membrane system 40 having a feed compartment 41, a permeate compartment 42 and a porous membrane 43. Effluent from the sodium sulfur cell exiting through line 208 enters the feed compartment 41 whereupon a portion of the feed passes through the membrane 43 and exits the system through line 210. A portion of the feed comprising liquid ammonia enriched in sulfur does not pass through the membrane and exits the membrane system through line 209. Sulfur may easily be removed from this concentrate by flash vaporization of the ammonia or by any number of other means known to those skilled in the art.

Liquid ammonia in line 210, now depleted of sulfur, is directed to the cathode side 52 of sodium sulfur cell 50 and dissolves elemental sodium as it is produced. The solution of regenerated sodium dissolved in liquid ammonia is then recirculated back to the feed system through line 211. Make-up sodium and ammonia, as needed, may be conveniently added through line 212.

In one embodiment, the temperature of operation is below the critical temperature and pressure of ammonia (132.6° C. and 1658 psia). One way of separating the precipitated sulfur from the liquid ammonia in line 209 may also be to raise this stream briefly above the critical temperature of ammonia, drop out the sulfur as a liquid and lower the temperature again to produce liquid ammonia. The transition from subcritical to supercritical and back again saves considerable energy over flash vaporization and is used commercially in the refining industry in deasphalting, i.e. the residual oil supercritical extraction (ROSE) process. The sodium sulfur cell is expected to operate at temperatures between 20° C. and 132° C. and at pressures between 100 psia and 1600 psia.

Although the present invention is described with several embodiments, various changes and modifications may be suggested to one skilled in the art. In particular, the present invention is described with reference to certain chemicals and materials and methods of processing those materials, but may apply to other types of processing or materials with little alteration and similar results. Furthermore, the present invention contemplates several process steps that may be performed in the sequence described or in an alternative sequence without departing from the scope and the spirit of the present invention. The present invention is intended to encompass such changes and modifications as they fall within the scope and the spirit of the appended claims.

What is claimed is:

1. A process for removing sulfur from a liquid hydrocarbon feed, comprising the steps of:

(a) dissolving metallic sodium in a first solvent to form a solution of sodium atoms;

(b) combining the solution of sodium atoms with second solvent to form a combined stream, wherein the combination occurs at a temperature of addition and at a pressure above the vapor pressure of the first solvent used to dissolve the metallic sodium at the temperature of addition;

(c) vaporizing the first solvent from the combined stream to create a reduced combined stream;

(d) dispersing the reduced combined stream into a liquid hydrocarbon feed stream comprising organosulfur species to form a hydrocarbon feed stream;

(e) passing the hydrocarbon feed stream into a pressurized reactor vessel in addition to a hydrogen-donor stream;

(f) reacting the hydrocarbon feed and hydrogen-donor streams to form a modified composition comprising sodium sulfide and less organosulfur species than previously present in the hydrocarbon feed stream, wherein the reaction occurs for a sufficient time and at a sufficient temperature; and (g) processing the sodium sulfide in a sodium sulfur cell to regenerate elemental sodium.

2. The process of claim 1, further comprising cooling the modified composition.

3. The process of claim 1, further comprising extracting the sodium sulfide from the modified composition using an extraction fluid.

4. The process of claim 1, wherein the first solvent is anhydrous ammonia.

5. The process of claim 1, wherein the second solvent is a substantially sulfur-free solvent.

6. The process of claim 5, wherein the substantially sulfur-free solvent may be selected from a group consisting essentially alkane or cycloalkane species, or combinations thereof.

7. The process of claim 6, wherein the alkane specie is mineral oil.

8. The process of claim 6, wherein the alkane species is aromatic-free substantially sulfur-free kerosene.

9. The process of claim 6, wherein the cycloalkane species is decahydronaphthalene.

10. The process of claim 1, wherein the temperature of addition is at or below the melting point of metallic sodium.

11. The process of claim 10, wherein the temperature of addition is about 25° C.

12. The process of claim 1, wherein the sufficient time is in the rage of about 5 to 60 minutes.

13. The process of claim 1, wherein the vaporization of first solvent occurs by lowering the pressure of the combined stream below the vapor pressure of the solvent at the temperature of addition.

14. The process of claim 1, wherein the sufficient temperature is in the range of about 25° C. to 350° C.

15. The process of claim 14, wherein the sufficient temperature is in the range of about 200° C. to 350° C.

16. The process of claim 3, wherein the extraction fluid includes a solvent for sodium sulfide.

17. The process of claim 16, wherein the solvent for sodium sulfide is substantially anhydrous ammonia.

18. The process of claim 1, wherein the molar ratio of sodium to sulfur is in the range of about 2.5:1 to 2:1.

19. The process of claim 1, wherein the hydrogen-donor stream may be selected from a group consisting essentially of hydrogen or a hydrogen donor solvent, or combinations thereof.

20. The process of claim 19, wherein the hydrogen donor solvent is tetra-hydronaphthalene.

21. The process of claim 19, wherein the hydrogen donor solvent is tetra-hydroquinoline.

22. The process of claim 1, further comprising recirculating the regenerated elemental sodium.

23. The process of claim 1, wherein the sodium sulfur cell comprises ammonia solvent.

* * * * *